United States Patent [19]

Spiegel

[11] Patent Number: 4,758,057

[45] Date of Patent: Jul. 19, 1988

[54] APPLIANCE SUPPORT

[75] Inventor: Raymond W. Spiegel, Lincoln Township, Berrien County, Mich.

[73] Assignee: Whirlpool Corporation, Benton Harbor, Mich.

[21] Appl. No.: 55,370

[22] Filed: May 29, 1987

Related U.S. Application Data

[63] Continuation of Ser. No. 336,770, Jan. 4, 1982, Pat. No. 4,693,526.

[51] Int. Cl.[4] ..... A47B 77/06

[52] U.S. Cl. ..... 312/320

[58] Field of Search ..... 312/249, 250, 228, 229, 312/254, 255, 256; 16/97; 134/115 R, 181; 248/188.8, 677

[56] References Cited

U.S. PATENT DOCUMENTS

| | | | |
|---|---|---|---|
| 2,542,244 | 2/1951 | Gerhardt et al. | 312/255 X |
| 2,961,282 | 11/1960 | Close | 312/255 |
| 2,981,549 | 4/1961 | Hotton | 312/250 X |
| 3,826,553 | 7/1974 | Cushing et al. | 312/229 X |
| 4,192,564 | 3/1980 | Losert | 312/253 |
| 4,359,250 | 11/1982 | Jenkins | 312/228 |

*Primary Examiner*—Joseph Falk

*Attorney, Agent, or Firm*—Wood, Dalton, Phillips, Mason & Rowe

[57] ABSTRACT

An appliance adapted to be installed in a space by rolling movement. The appliance includes a housing with a mechanism projecting downwardly from the bottom portion thereof. Rollers are disposed at opposite sides of the housing to be laterally subjacent the bottom portion of the mechanism whereby the front portion of the housing may be lifted to permit rolling movement of the appliance on the rollers free of engagement of the mechanism with the subjacent surface on which the housing is being moved. Levelers are provided at the front of the housing to retain the appliance in cooperation with the rollers in a level, supported disposition.

5 Claims, 1 Drawing Sheet

APPLIANCE SUPPORT

This is a continuation of application Ser. No. 336,770, filed Jan. 4, 1982, now U.S. Pat. No. 4,693,526.

BACKGROUND OF THE INVENTION

1. Field of the Invention

This invention relates to an appliance support and in particular to a roller support for use with an appliance, such as a dishwasher, permitting facilitated installation and leveling thereof as in an undercounter space.

2. Description of the Background Art

A number of leveling devices have been provided for different appliances. One such device is illustrated in U.S. Pat. No. 2,281,769, of Gustav F. Hochriem. As shown therein, a platform scale is provided with a rotatably adjustable shaft carrying cams having straight portions for engagement with an underlying floor. The rear housing of the scale is provided with rollers.

Michael H. Devery illustrates, in U.S. Pat. No. 2,874,971, another appliance support arrangement wherein supporting feet are provided intermediate a pair of front and rear wheels. The feet and rear wheels constitute the normal cabinet support means. However, when desired, the front wheels may be lowered so as to permit rolling movement of the cabinet on both the front and rear wheels.

U.S. Pat. No. 4,192,564, of Gerhard K. Losert, shows a load-equalizing support for use with a refrigerator cabinet. The support includes movable members associated with each of a pair of widely spaced wheel assemblies. The movable members are connected by a rod so that the corresponding wheel assembly is moved downwardly with a similar force. Vertically threaded supports are provided at the front of the cabinet.

A problem arises in the prior art roller support systems in that a substantial force is required to lift the front portion of the appliance in permitting rolling movement on the rear mounted wheels. The center of gravity of the appliance is substantially forwardly of the rear mounted wheels and, thus, it causes a substantial downward force acting against the lifting action.

SUMMARY OF THE INVENTION

The present invention comprehends an improved adjustable support for an appliance or the like wherein the rollers thereof are disposed substantially forwardly of the back of the cabinet so as to provide a substantially shortened moment arm of the cehter of gravity relative thereto, thereby permitting facilitated lifting of the front portion of the appliance such as during installation in an undercounter space.

More specifically, the invention comprehends the provision in an appliance having a housing defining a bottom portion including a front, a rear and an intermediate portion, and an operating mechanism having a portion projecting downwardly from the housing bottom intermediate portion to define a bottom portion of the mechanism of an improved means for adjustably supporting the appliance including downwardly extending vertically adjustable levelers mounted one each to opposite sides of the housing bottom front portion, and a pair of rollers mounted one each to opposite sides of the housing to be disposed laterally subjacent the bottom portion of the operating mechanism whereby the front portion of the housing may be lifted to permit rolling movement of the housing on the rollers free of engagement of the mechanism bottom portion with the surface on which the housing is being moved.

The appliance defines a center of gravity acting downwardly a short distance forwardly of the rollers.

In the illustrated embodiment, the rollers are disposed subjacent the rearmost portion of the mechanism, which illustratively comprises an electric motor for driving a pump or the like.

In the illustrated embodiment, means are provided for adjusting the mounting of the rollers.

In the illustrated embodiment, a pair of side supports are provided disposed one each on opposite sides of the housing for mounting the rollers.

The side supports further define a front mounting portion for mounting levelers.

In the illustrated embodiment, the side supports comprise L-shaped brackets having a corner portion defining the front leveler mounting portion and a horizontal bottom leg having a distal end defining a rearward roller mounting portion.

The appliance support means of the invention is extremely simple and economical of construction while yet providing facilitated movement of the appliance, such as during installation in an undercounter space or the like.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
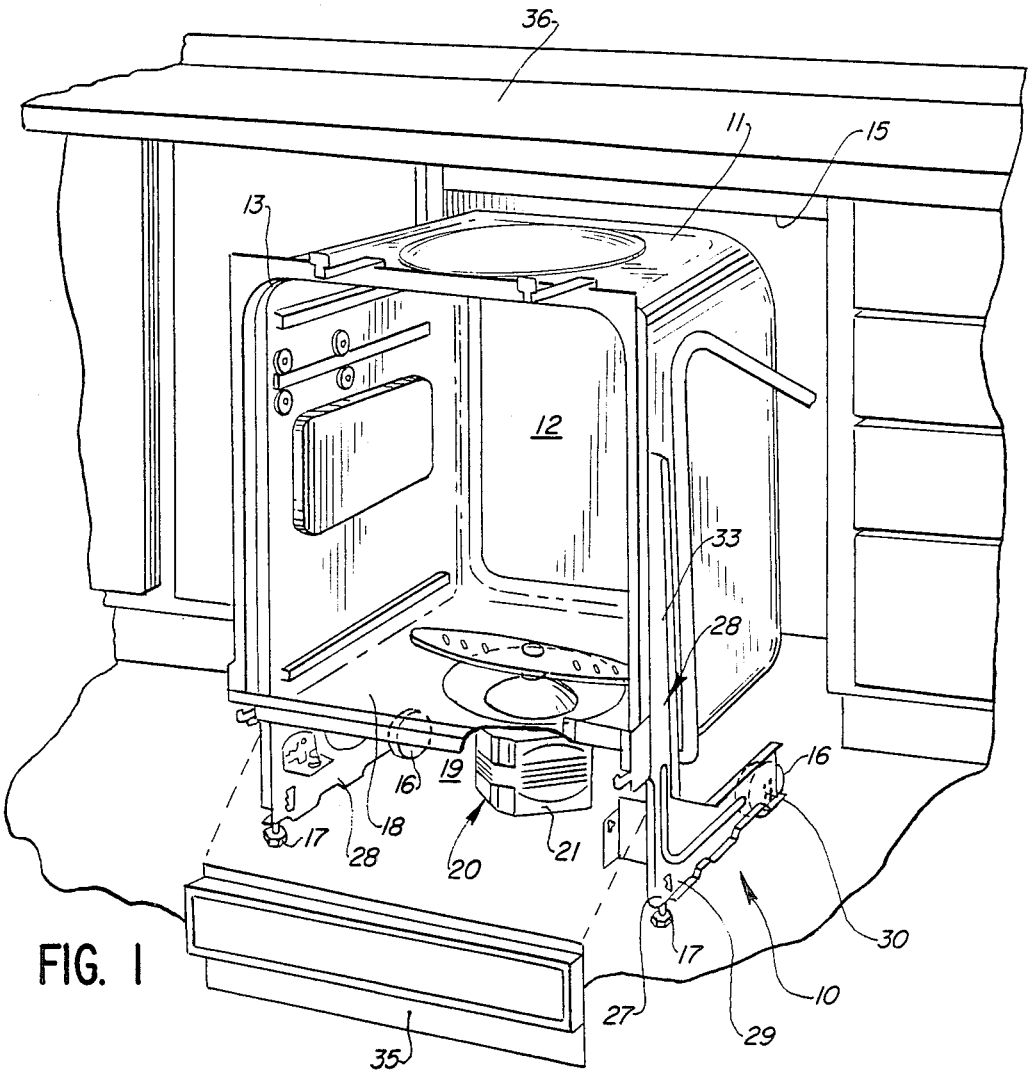
FIG. 1 is a fragmentary perspective view of an appliance having improved means for adjustable support thereof embodying the invention.

In the exemplary embodiment of the invention as disclosed in FIG. 1, an appliance assembly generally designated 10 is shown to comprise a dishwasher appliance structure having a tub, or housing, 11 defining a dishwashing cavity 12. The housing defines a front opening 13 to the cavity, which is selectively closed by a closure, or front door, 14 (FIG. 2) providing selective access to the cavity when desired.

The appliance, in the illustrated embodiment, is adapted to be installed in an undercounter space 15 provided in a conventional kitchen counter 36, or the like. The installation of the appliance is effected by moving the appliance rearwardly into the space, and for this purpose, the appliance is provided with a pair of rollers, or wheels, 16 at opposite sides of the housing.

To provide a level installation of the appliance within the counter space 15, a pair of adjustable levelers, or feet, 17 are mounted to the housing adjacent the front opening 13.

As further shown in FIG. 1, the housing defines a bottom wall 18 which overlies a subjacent apparatus space 19 in which is mounted operating mechanisms for the appliance, such as motor-pump combination 20, for circulating liquid within the cavity 12 to cleanse dishes placed therein. The lowermost portion of the combination 20 is defined by an electric drive motor 21.

Figure 2:
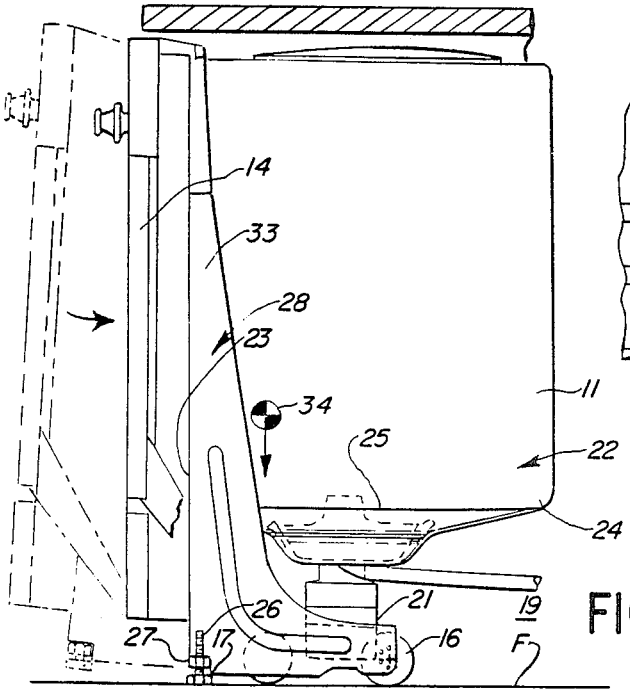
FIG. 2 is a side elevation of the appliance shown in the installed disposition within an undercounter space in full lines and shown fragmentarily in a forwardly disposed disposition as during installation.

Thus, as seen in FIG. 2, the housing 11 defines a bottom portion generally designated 22 including a front portion 23, a rear portion 24, and an intermediate portion 25. The pump motor 21 projects downwardly from the housing intermediate portion 25 to define a bottom portion of the mechanism in the machinery space 19.

As best seen in FIG. 2, the rollers 16 and levelers 17 define an improved means for adjustably supporting the appliance. As shown, the two levelers 17 are independently vertically adjustable by means of a threaded shaft 26 thereof being adjustably threaded through a flange 27 on supports 28 provided one each at opposite sides of the housing.

Figure 3:
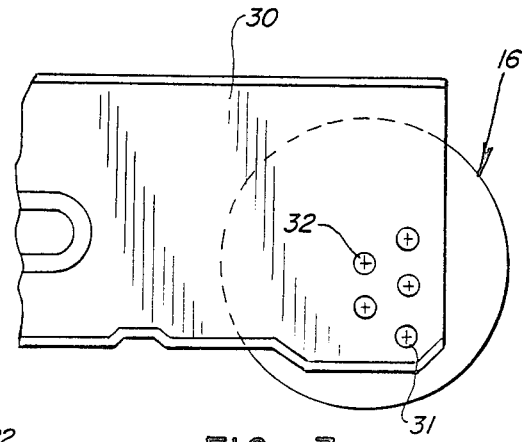
FIG. 3 is a fragmentary enlarged side elevation illustrating the mounting of a roller to the distal end of a side support.

More specifically, as seen in FIGS. 1 and 2, each of the supports 28 comprises an L-shaped element defining a front mounting portion 29 and a rearward mounting portion 30. The rearward mounting portion comprises the distal ends of the horizontal bottom leg of the L-shaped support and as seen in FIG. 3 is provided in the distal end portion with a plurality of openings 31 at different elevations for selectively receiving an axle 32 of the roller 16, whereby the roller may be selectively vertically adjusted for independent leveling action of the housing by the selected disposition of the rollers.

As best seen in FIG. 1, the front mounting portion 29 of the support comprises the corner portion of the support 28 and an upright leg 33 of the support is fixedly secured to the sidewall of the housing to provide a strong, rigid mounting of the adjustable support means to the housing 11.

As illustrated in FIG. 2, the center of gravity 34 of the appliance is disposed adjacent the front portion 23 of the housing bottom portion 22, and more specifically, is disposed forwardly of the vertical center of the pump motor 21. Rollers 16 are preferably disposed closely rearwardly adjacent the vertical transverse plane of the center of gravity so as to effectively minimize the moment arm when it is desired to lift the front portion of the cabinet as during installation in the undercounter space 15, permitting the appliance to be readily moved into the space on the rollers 16. However, as seen in FIG. 2, rollers 16 are spaced somewhat rearwardly of the transverse plane of the center of gravity so as to be subjacent the rearmost portion of the electric motor 21, thereby effectively preventing engagement of the motor with a subjacent floor surface F, as could occur if the rollers were disposed forwardly thereof, as a result of the upward lifting of the front portion of the cabinet and the corresponding downward movement of the portion rearwardly of the rollers. Thus, the invention comprehends locating the rollers closely adjacent the transverse plane of the center of gravity while yet, at the same time, disposing them subjacent a rear portion of the lowermost downwardly projecting portion of the appliance mechanism in the appliance space so as to effectively avoid undesirable engagement of the mechanism with the floor surface during the installation movement.

The prevention of the engagement of the motor with the floor surface F is effected in any of the adjusted positions of the roller on the support portion 30, thereby effectively avoiding damage to the mechanism during installation. Such contact is advantageously provided in appliances, such as dishwashers and the like, where impact of the downwardly projecting portion of the mechanism may tend to break sealed connections as between the dishwasher tub and pump.

As each of the levelers and rollers is independently adjustable, leveling of the appliance may be readily effected not only with respect to the fore-and-aft direction, but also with respect to the transverse or side-to-side direction. Movement of the appliance into and from the installation space is readily effected with minimum effort because of the unique disposition of the rollers relative to the center of gravity of the appliance.

As shown in FIG. 1, after the appliance is installed in the space 15, the machinery space 19 may be closed by a lower panel 35. The housing may be secured to the counter 36 as by suitable threaded securing means.

The foregoing disclosure of specific embodiments is illustrative of the broad inventive concepts comprehended by the invention.

I claim:

1. In an appliance having a center of gravity, a housing having a front, rear and opposite sides and defining a bottom portion including a front, a rearmost, and an intermediate poriton, and an operating mechanism having a portion projecting downwardly from said housing bottom intermediate portion to define a bottom portion of the operating mechanism, improved means for adjustably supporting the appliance for facilitated rearward movement of the appliance with the front portion being raised, said means comprising:

first and second rigid side supports each having a vertically extending leg and a mounting portion;

means fixedly mounting the vertically extending legs of the first and second side supports one each to opposite sides of the housing adjacent the front of the housing so that the legs project vertically upwardly to above said center of gravity and the mounting portion is adjacent said bottom portion of the housing;

downwardly extending vertically adjustable levelers;

means mounting one each of said adjustable levelers to the side support mounting portions at opposite sides of said housing adjacent the bottom front housing portion;

a pair of rollers; and means mounting one each of said rollers to the side support mounting portions at opposite sides of said housing substantially forwardly of said housing rearmost portion more closely to the center vertical plane of the appliance than to said rearmost portion to be disposed laterally rearwardly and adjacent the downwardly projecting portion of the operating mechanism whereby said front portion of the housing may be readily lifted by exerting a rearwardly directed force on said housing and side support legs above the center of gravity to permit rolling movement of the housing on said rollers free of engagement of said mechanism bottom portion and said adjustable levelers with the surface on which the housing is being moved, said center of gravity acting downwardly a short distance forwardly of said rollers.

2. The appliance structure of claim 1 including means for vertically adjusting the mounting of the rollers relative to said housing bottom portion.

3. The appliance structure of claim 1 wherein said bottom portion of the mechanism comprises an electric motor.

4. The appliance structure of claim 1 wherein said side supports comprise L-shaped brackets having a corner portion to which the levelers are mounted and a horizontal bottom leg defining said mounting portion.

5. In an appliance having a center of gravity, a housing having a front, rear and opposite sides and defining a bottom portion including a front, a rearmost, and an intermediate portion, and an operating mechanism having a portion projecting downwardly from said housing bottom intermediate portion to define a bottom portion of the mechanism, improved means for adjustably supporting the appliance for facilitated rearward movement of the appliance with the front portion being raised, said means comprising:

a first pair of rigid L-shaped appliance side supports;

means mounting a vertical leg of each support on opposite sides of said housing adjacent the front of the housing so that the vertical legs project vertically upwardly to above said center of gravity and so that at least a portion for a horizontal leg of each side support is situated beneath the bottom housing portion;

downwardly extending vertically adjustable levelers;

means mounting one of said levelers to each of said L-shaped supports at the juncture of the horizontal and vertical legs;

a pair of rollers; and means mounting one of the rollers to each horizontal side support leg substantially forwardly of said housing rearmost portion more closely to the center vertical plane of the appliance than to said rearmost portion to be disposed laterally and adjacent the downwardly projecting portion of the operating mechanism, said center of gravity acting downwardly a short distance forwardly of said rollers, each of said rollers comprising means for leveling the appliance, whereby said front portion of the housing may be readily lifted by exerting a rearwardly directed force on said housing and side support legs above the center of gravity to permit rolling movement of the housing on said rollers free of engagement of said mechanism bottom portion and said levelers with the surface on which the housing is being moved.

* * * * *